US006749457B2

(12) United States Patent
Sakaguchi et al.

(10) Patent No.: US 6,749,457 B2
(45) Date of Patent: Jun. 15, 2004

(54) CRIMP TERMINAL

(75) Inventors: Tadahisa Sakaguchi, Haibara-gun (JP); Toshihiro Maki, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/193,122

(22) Filed: Jul. 12, 2002

(65) Prior Publication Data

US 2003/0013353 A1 Jan. 16, 2003

(30) Foreign Application Priority Data

Jul. 13, 2001 (JP) ..... P2001-213950

(51) Int. Cl.[7] ..... H01R 4/10
(52) U.S. Cl. ..... 439/421; 439/877; 439/882
(58) Field of Search ..... 439/421, 877–882

(56) References Cited

U.S. PATENT DOCUMENTS 3,355,698 A * 11/1967 Keller ..... 439/421
3,510,829 A 5/1970 Keller
3,812,448 A * 5/1974 Haitmanek ..... 439/421
4,003,623 A 1/1977 Reynolds

FOREIGN PATENT DOCUMENTS

| | | |
|---|---|---|
| DE | 1 763 068 | 3/1958 |
| DE | 25 39 323 C2 | 3/1975 |
| DE | 198 12 093 C1 | 10/1999 |
| DE | 199 22 560 A1 | 11/2000 |
| GB | 665493 | 1/1952 |
| GB | 820243 | 9/1959 |
| JP | 59-165390 | 9/1984 |

* cited by examiner

*Primary Examiner*—Gary F Paumen
(74) *Attorney, Agent, or Firm*—Sughrue Mion, PLLC

(57) ABSTRACT

In a crimp terminal for crimping at least one bare conductor of at least one sheathed electric wire, the at least one bare conductor is placed on a bottom plate. A pair of crimp craws extend from the bottom plate to crimp the at least one bare conductor placed on the bottom plate. A plurality of serrations are formed at least on an inner face of the bottom plate to bite the at least one bare conductor crimped by the crimp claws. At least one of the serrations has a depth different from a depth of each another serration.

3 Claims, 5 Drawing Sheets

CRIMP TERMINAL

BACKGROUND OF THE INVENTION

The present invention relates to a crimp terminal for connecting electric wires by crimping, and more particularly to an improvement of conductor engaging grooves (serrations) which are formed on an inner face of a bottom plate part, etc. of the terminal, and advantageously contribute to an improvement of electrical connecting performance as well as an improvement of mechanical connecting performance between the terminal and conductors of the electric wires.

FIGS. 6 and 7 show examples of related-art crimp terminals.

A crimp terminal 1 as shown in FIG. 6 is the crimp terminal for screw fitting, and includes a terminal portion 2 for screw fitting which has a screw insertion hole 2*a* formed at its distal end, a conductor crimping portion 4 and a sheath crimping portion 5 which are provided in order behind the terminal portion 2. These portions are integrally formed of a sheet of metal plate by stamping process.

The conductor crimping portion 4 is a portion for connecting bare conductors 7*b* by crimping, which are exposed by removing an insulation sheath 7*a* from a sheathed electric wire 7, as also shown in FIG. 8. The conductor crimping portion 4 has a bottom plate part 4*a* on which the bare conductors 7*b* are placed, and a pair of crimp claws 4*b* which are adapted to be crimped onto the bare conductors 7*b* placed on this bottom plate part 4*a*, by a crimping equipment 9 (See FIG. 9).

The sheath crimping portion 5 is a portion for crimping the sheathed electric wire 7 to fix it together with the insulation sheath 7*a*, and includes a bottom plate part 5*a* on which the sheathed electric wire 7 is placed, and a pair of crimp claws 5*b* which are crimped onto the sheathed electric wire 7 placed on the bottom plate part 5*a*, by the crimping equipment 9 (See FIG. 9).

The crimping equipment 9 is a kind of pressing apparatus which includes, as shown in FIGS. 9 and 10, an anvil 9*a* for supporting the bottom plate parts 4*a*, 5*a* of the conductor crimping portion 4 and the sheath crimping portion 5, and two crimpers 9*b*, 9*c* provided above the anvil 9*a* so as to move up and down for respectively crimping the crimp claws 4*b* and the crimp claws 5*b*.

Meanwhile, a crimp terminal 11 as shown in FIG. 7, is a relaying crimp terminal for connecting conductors of a plurality of sheathed electric wires 12*a*, 12*b*, 12*c* together in a bundle, and has a bottom plate part 11*a* on which a plurality of bare conductors 13 are placed, and a pair of crimp claws 11*b* which are extended from both sides of the bottom plate part 11*a* and adapted to be crimped onto the bare conductors 13 placed on the bottom plate part 11*a*, by a crimping equipment. The bottom plate part 11*a* and the crimp claws 11*b* are integrally formed of a sheet of metal plate by stamping process.

It has been known that in order to enhance electrical connecting performance and mechanical connecting performance between the bare conductors and the bottom plate parts of these crimp terminals, a plurality of conductor engaging grooves 17 in a concave shape (hereinafter referred to as "serrations") extending in a direction intersecting axes of the bare conductors (usually, in a perpendicular direction) are provided on an inner face 16 of the bottom plate part, etc. of the terminal to be contacted with the bare conductors, as shown in FIGS. 11 and 12.

In this case, all the serrations have a groove width and a groove depth of the same size, and are in the same shape.

When the crimp claws 4*b*, 11*b* have been crimped, groove edges of the serrations 17 are intensively pressed so as to adequately bite the bare conductors 7*b*, 13 on the surface, and both the mechanical connecting performance and the electrical connecting performance can be improved, ensuring reliability of the connection by crimping.

By the way, in order that oxidized coatings formed by oxidation on the surfaces of the conductors may be removed when the edges of the serrations 17 have bitten the bare conductors 7*b*, 13 by the edges, it is necessary for the serrations 17 to be set to have a large amount of bite, and it is necessary to make the serrations 17 deep for an increase of the amount of bite.

On the other hand, in case where the serrations have been set to have a large amount of bite, stresses will be converged on crimped areas of the conductors when a tensile force is exerted on the bare conductors 7*b*, 13 from outside. As the results, the bare conductors 7*b*, 13 will be likely to be broken, resulting in deterioration of the mechanical connecting performance.

Under the circumstances, in order that improvements of the electrical connecting performance and the mechanical connecting performance may be obtained while keeping their balance, the depth of the serrations 17 and crimping amounts of the crimp claws can be determined in consideration of outer diameters of the bare conductors.

However, there have been many cases in which the crimp terminals employed in a wire harness or the like for a motor vehicle must connect the sheathed electric wires having various diameters, or must crimp the conductors having different outer diameters together in a bundle.

For this reason, it is extremely difficult to determine the depth of the serrations 17 and the crimping amounts of the crimp claws so that improvements of both the electrical connecting performance and the mechanical connecting performance can be obtained while keeping their balance. For example, in case where a plurality of the bare conductors having different outer diameters have been crimped together in a bundle, even though the large diametered bare conductors may be improved both in the electrical connecting performance and the mechanical connecting performance, the small diametered bare conductors may be too much engaged by the serrations 17, resulting in a probability that even a slight tensile force may break the bare conductors.

Moreover, in case where the mechanical connecting performance is intended to be ensured, by setting the depth of the serrations 17 according to the bare conductor having the smallest diameter among the bare conductors 7*b*, 13 to be crimped, there has been such an anxiety that in the bare conductors having the larger diameters, the edges of the grooves cannot sufficiently remove the oxidized coatings on the surfaces of the conductors, incurring defective electrical connecting performance.

In order to eliminate such disadvantages contradicting each other, a crimp terminal 21 as shown in FIGS. 13 and 14 has been proposed.

This crimp terminal 21 is disclosed in Japanese Patent Publication No. JP 59-165390A, and includes two conductor crimping portions 23, 24 having different crimping amounts. The conductor crimping portion 23 positioned at a proximal end side of the bare conductors forms a crimping part having a small amount of bite of the serrations with respect to the conductors, by adjusting a height of the crimp claws 23*b*, 23*b* and controlling a crimper 26*b* in a crimping equipment 26 so as to obtain a smaller crimping amount.

On the other hand, the conductor crimping portion 24 which is positioned at a distal end side of the bare conductors forms a crimping part having a large amount of bite of the serrations with respect to the conductors, by adjusting a height of the crimp claws 24*b*, 24*b* and controlling a crimper 26*c* in the crimping equipment 26 so as to obtain a larger crimping amount.

In this manner, by providing two types of the conductor crimping portions 23, 24 having different crimping amounts, incomplete or excessive amount of bite by the serrations has been eliminated, even in case where the bare conductors having small diameters and large diameters are mixed, and both the electrical connecting performance and the mechanical connecting performance have been able to be improved.

However, in the crimp terminal 21 as shown in FIGS. 13 and 14, an increase in number of the conductor crimping portions 23, 24 has incurred a problem that a structure of the terminal has become complicated and large-sized. In addition, the crimping equipment 26 has become also complicated due to an addition of the crimper 26*c*, and there has arisen a problem that cost for the equipment might be increased.

SUMMARY OF THE INVENTION

It is therefore an object of the invention to provide a crimp terminal in which, on occasion of crimping operation when the bare conductors of both small diameters and large diameters are mixed, an excessive or incomplete bite in any conductor can be eliminated, without incurring a complicated and large-sized structure of the crimp terminal, and also without incurring a complicated crimping equipment, and both electrical connecting performance and mechanical connecting performance can be improved at a low cost.

In order to achieve the above object, according to the present invention, there is provided a crimp terminal for crimping at least one bare conductor of at least one sheathed electric wire, comprising:

a bottom plate, on which the at least one bare conductor is placed;

a pair of crimp craws, extending from the bottom plate to crimp the at least one bare conductor placed on the bottom plate; and a plurality of serrations formed at least on an inner face of the bottom plate to bite the at least one bare conductor crimped by the crimp claws, wherein at least one of the serrations has a depth different from a depth of each another serration.

In this construction, when the crimping operation is performed, the shallow serration will prevent an excessive bite thereby to attain improvement of the mechanical connecting performance, and on the other hand, the deep serration will prevent the oxidized coating from remaining due to an incomplete bite thereby to attain improvement of the electrical connecting performance.

Further, the serrations having different depths can ensure appropriate amounts of bite with respect to both the bare conductors having a small diameter and a large diameter, although no additional crimping structure is required.

Therefore, on occasion of crimping operation when the bare conductors having both a small diameter and a large diameter are mixed, an excessive or incomplete bite with respect to either conductor can be eliminated, without incurring a complicated and large-sized structure of the crimp terminal, and also without incurring a complicated crimping equipment, and both the electrical connecting performance and the mechanical connecting performance can be improved at a low cost.

Preferably, a depth of a serration situated closer to an end of the bottom plate at which the sheathed electric wire is placed is shallower than a depth of another serration.

When plural sheathed electric wires are placed at both ends of the bottom plate, it is preferable that depths of serration closer to the both ends of the bottom plate are shallower than a depth of another serration.

In these cases, it is possible to decrease an amount of bite between the serrations and the bare conductors at the proximal end side of the bare conductors, so that deterioration of the mechanical connecting performance due to an excessive bite can be reliably prevented.

Preferably, a depth of a center portion of the at least one serration in an extending direction thereof is shallower than depths of both end portions thereof.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Now, preferred embodiments of a crimp terminal according to the present invention will be described in detail, referring to the accompanying drawings.

Figure 1:
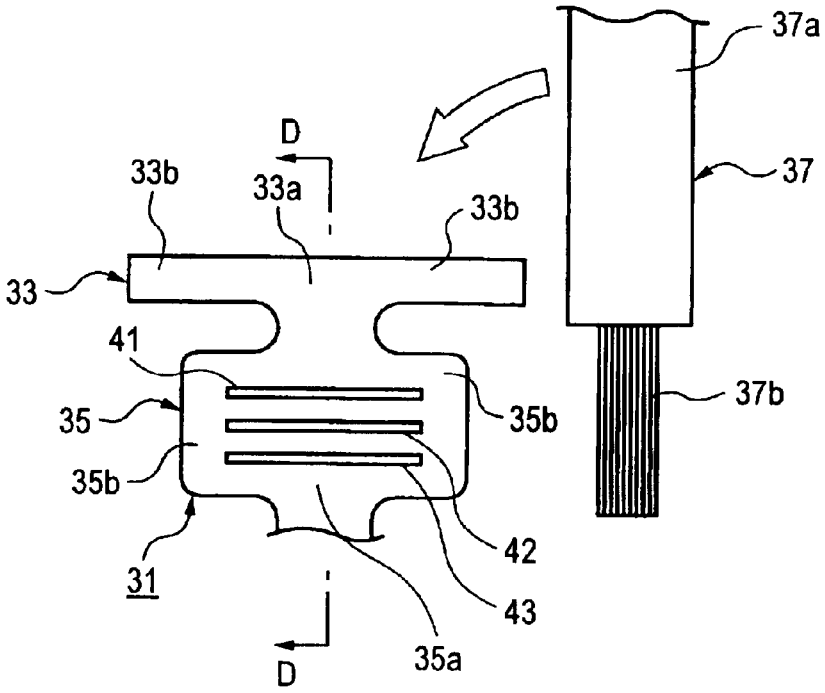
FIG. 1 is a developed view of a conductor crimping portion of a crimp terminal according to a first embodiment of the present invention.

A crimp terminal 31 according to a first embodiment is a crimp terminal for screw fitting which is integrally formed of a metal plate by stamping process. As shown in FIG. 1, the crimp terminal 31 is constructed in such a manner that in order from its proximal end side, a sheath crimping portion 33 and a conductor crimping portion 35 are continuously provided.

Figure 9:
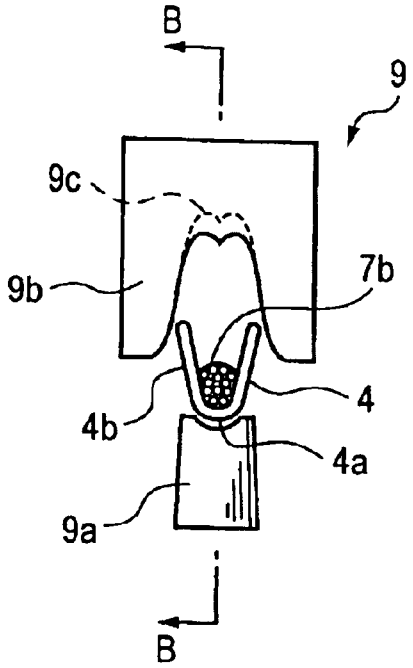
FIG. 9 PRIOR ART
FIG. 9 is a front view of a crimping equipment for conducting crimping operation of crimp claws on the crimp terminal.
Figure 10:
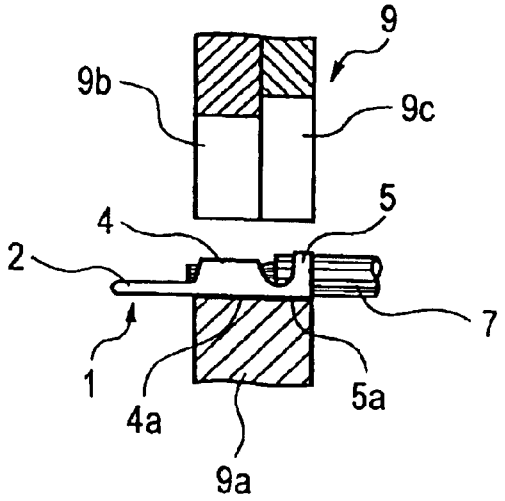
FIG. 10 PRIOR ART
FIG. 10 is a sectional view taken along a line B—B of FIG. 9.
Figure 11:
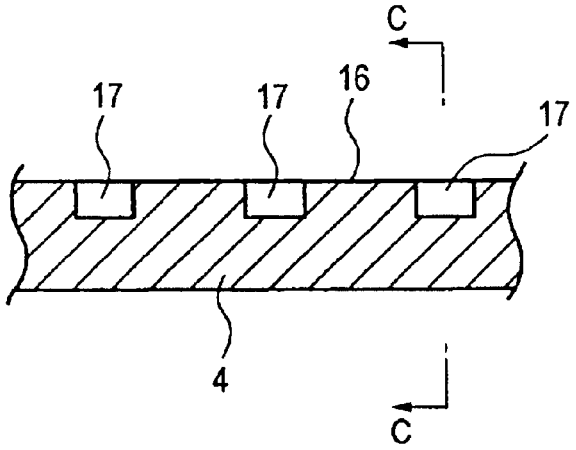
FIG. 11 PRIOR ART
FIG. 11 is a sectional view taken along a line A—A of FIG. 8.
Figure 12:
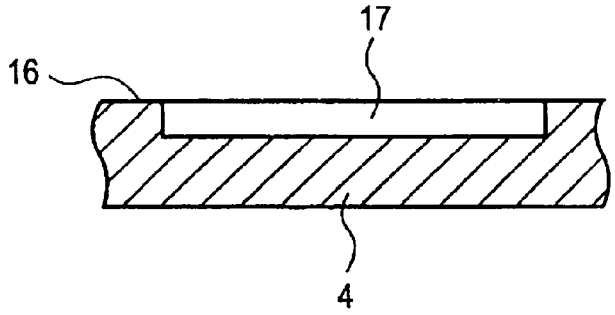
FIG. 12 PRIOR ART
FIG. 12 is a sectional view taken along a line C—C of FIG. 11.
Figure 13:
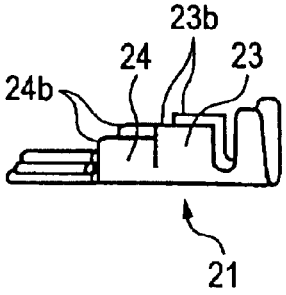
FIG. 13 PRIOR ART
FIG. 13 is a perspective view of a related-art crimp terminal of two-step crimping type.
Figure 14:
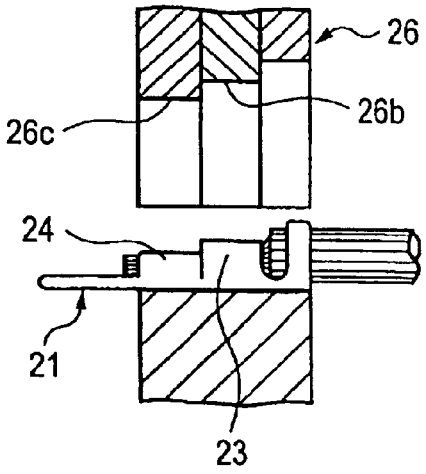
FIG. 14 PRIOR ART
FIG. 14 is a vertical sectional view of a crimping equipment for conducting crimping operation of the crimp terminal shown in FIG. 13.

The sheath crimping portion 33 has a bottom plate part 33*a* on which a sheathed electric wire 37 is placed, and a pair of crimp claws 33*b* extended from both sides of the bottom plate part 33*a*. By crimping a pair of the crimp claws 33*b* onto the sheathed electric wire 37 together with the insulation sheath 37*a* by the crimping equipment 9 (See FIGS. 9 and 10), the sheathed electric wire 37 is secured.

Figure 2:
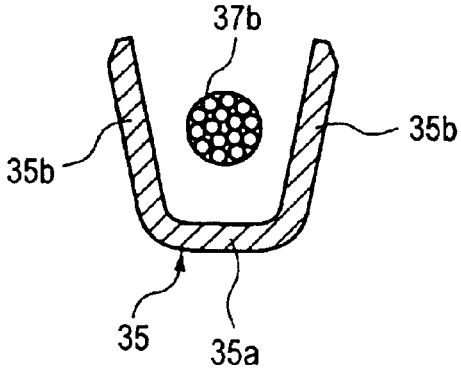
FIG. 2 is a cross sectional view of the conductor crimping portion shown in FIG. 1.

As shown in FIG. 2, the conductor crimping portion 35 has a bottom plate part 35*a* adapted to support bare conductors 37*b* which are exposed by removing an insulation sheath 37*a* from one end portion of the sheathed electric wire 37, and a pair of crimp claws 35*b* extended from both sides of this bottom plate part 35*a*. By crimping a pair of the crimp claws 35*b* onto the bare conductors 37*b* by the crimping equipment 9, the sheathed electric wire 37 is fixed.

The conductor crimping portion 35 is provided with three conductor engaging grooves, so-called serrations 41, 42, 43 which extend in a direction intersecting axes of the bare conductors 37*b*, on inner faces of the bottom plate part 35*a* and the crimp claws 35*b* to be contacted with the bare conductors 37*b*.

These serrations 41, 42, 43 act in such a manner that edges of the grooves may bite the bare conductors 37*b* when the crimp claws 35*b* have been crimped, and electrical connecting performance and mechanical connecting performance between the bare conductors 37*b* and the conductor crimping portion 35 may be enhanced. A width w is the same in all the grooves.

However, in this embodiment, among the three serrations 41, 42 and 43, the serration 41 located adjacent to an end of the bottom plate portion 35*a* corresponding to a proximal end side of the bare conductors 37*b* is set to have a groove depth h1 which is smaller than a groove depth h2 of the other two serrations 42, 43 which are located adjacent to a center and adjacent to a distal end of the bottom plate part 35*a*, so that the serrations 41, 42, 43 may have different amounts of bite with respect to the bare conductors 37*b*.

In the crimp terminal 31 constructed in this manner, when the bare conductors 37*b* on the bottom plate part 35*a* have been crimped by crimping operation of the crimp claws 35*b*, respective edges of the serrations 41, 42, 43 are adapted to bite the bare conductors 37*b* on the surface. On this occasion, the serration 41 having the smaller groove depth h1 will be prevented from excessively biting the conductors 37*b*, thus enhancing the mechanical connecting performance with an appropriate bite.

On the other hand, the serrations 42, 43 having the larger groove depth h2 will remove an oxidized coating formed on the surfaces of the bare conductors 37*b* with a deep bite, thus enhancing the electrical connecting performance.

Although the above described function has been described referring to a case in which the bare conductors to be applied have a small outer diameter, it is apparent that in case where the bare conductors have a large outer diameter, the serrations 42, 43 having the large groove depth h2 can ensure an appropriate amount of bite which is suitable for both the electrical connecting performance and the mechanical connecting performance. Therefore, such an inconvenience that either one of the electrical connecting performance and the mechanical connecting performance may become defective will not occur.

Moreover, in the above described embodiment, the groove depths of the three serrations 41, 42, 43 are set in a plurality of different sizes so as to ensure appropriate amounts of bite with respect to both the bare conductors 37*b* having a small diameter and a large diameter, and so, any additional structure or the like to the conductor crimping portion on the crimp terminal 31 is absolutely unnecessary.

Accordingly, even in case where the bare conductors having a large diameter and a small diameter are mixed, excessive or incomplete amount of bite can be eliminated with respect to the conductors of any size, without incurring a complicated or large-sized structure of the crimp terminal 31, and also without incurring a complicated crimping equipment. Thus, both the electrical connecting performance and mechanical connecting performance can be improved at a low cost.

Figure 3:
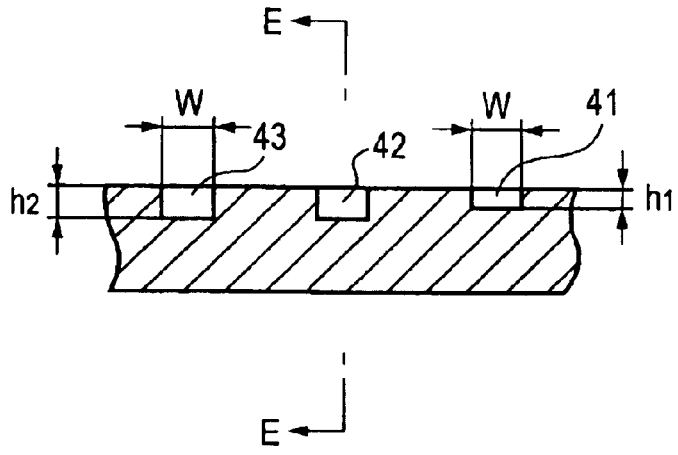
FIG. 3 is a sectional view taken along a line D—D of FIG. 1.

Further in the present embodiment, the serration 41 located corresponding to the proximal end side of the bare conductors 37*b* has been set to have the smaller groove depth than the groove depth of the other serrations 42, 43 which are located adjacent to the center part of the bottom plate part 35*a*, as shown in FIG. 3. As the results, it is possible to decrease the amount of bite between the groove and the conductors at the proximal end side of the bare conductors 37*b*, and deterioration of the mechanical connecting performance due to an excessive bite can be reliably prevented.

Figure 4:
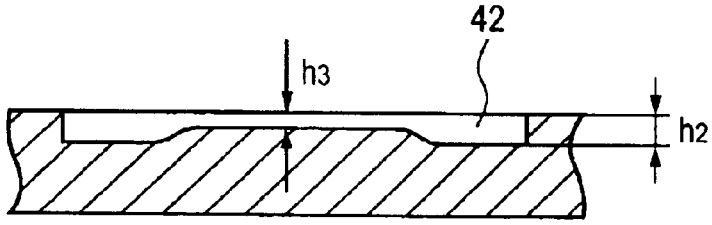
FIG. 4 is a sectional view taken along a line E—E of FIG. 3, showing a crimp terminal according to a second embodiment of the present invention.
Figure 5:
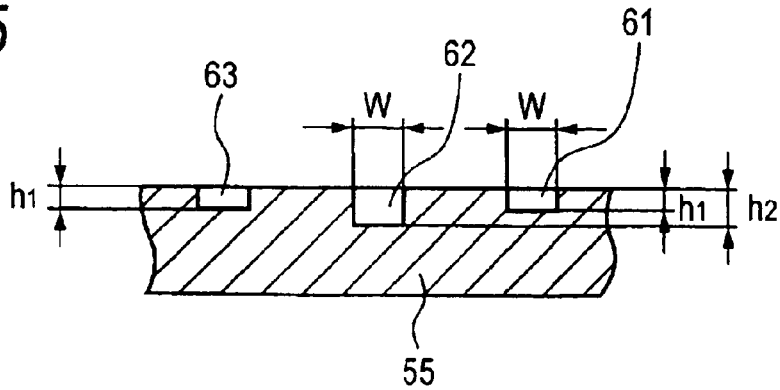
FIG. 5 is a sectional view of a conductor crimping portion, showing a crimp terminal according to a third embodiment of the present invention.
Figure 6:
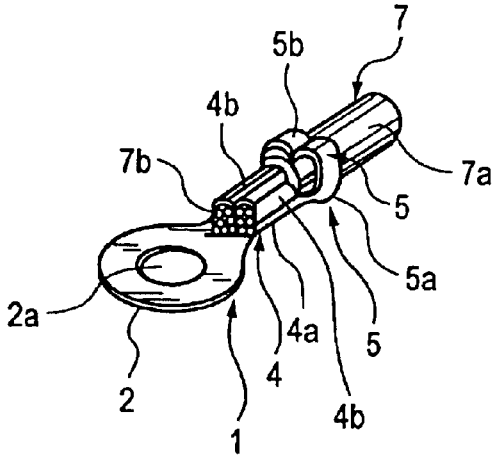
FIG. 6 PRIOR ART
FIG. 6 is a perspective view of a related-art crimp terminal.
Figure 7:
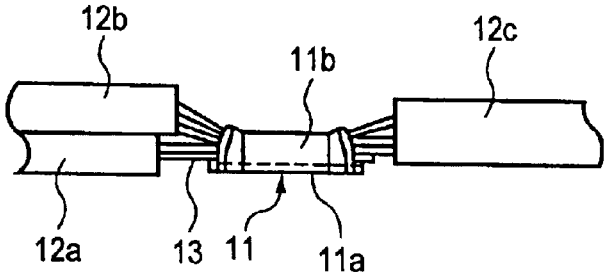
FIG. 7 PRIOR ART
FIG. 7 is a side view of a related-art relaying crimp terminal.
Figure 8:
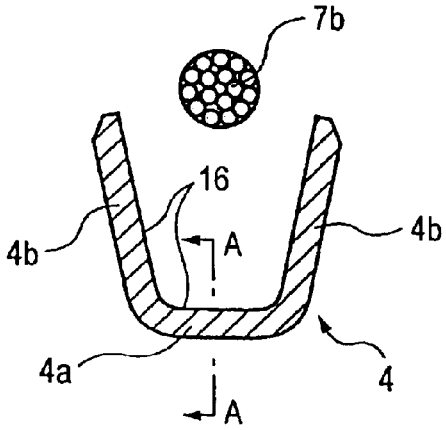
FIG. 8 PRIOR ART
FIG. 8 is a cross sectional view of a conductor crimping portion of the related-art crimp terminals.

Next, a second embodiment of the present invention will be described referring to FIG. 4, which is a sectional view taken along a line E—E of FIG. 3. Specifically, in the first embodiment, the groove depths of the serrations 41, 42, 43 are constant inside the respective serrations 41, 42, 43. However, in this embodiment, in the serration 42 located in the middle, a depth h3 at a center part of the groove is set to be smaller than a depth h2 at both end parts of the groove.

With this structure, the center part of the serration 42 located in the middle of the three serrations can be positively utilized for engaging a small diametered conductor. Meanwhile, the large depth h2 at the both end parts of this serration 42 can attain a deep bite, and improved electrical connecting performance can be obtained. Structures of other parts in this embodiment are the same as in the preceding embodiment.

It is to be noted that although the crimp terminal for screw fitting has been illustrated in the above described embodiments, the present invention can be applied to the relaying crimp terminal which is adapted to connect a plurality of electric wires together by crimping, as a third embodiment of the invention.

In this embodiment, it is desirable that among three serrations 61, 62, 63 provided on an inner face of a conductor crimping portion 55, the serrations 61 and 63 located at both end parts are set to have a small groove depth h1 so as to contribute to mechanical connection, and the serration 62 located in the center is set to have a large groove depth h2 so as to contribute to electrical connection.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

For example, number of the serrations to be provided on the inner face of the conductor crimping portion is not limited to the above described embodiment. An arbitrary number of more than two can be selected.

What is claimed is:

1. A crimp terminal for crimping at least one bare conductor of at least one sheathed electric wire, comprising:

a bottom plate, on which the at least one bare conductor is placed;

a pair of crimp claws, extending from the bottom plate to crimp the at least one bare conductor placed on the bottom plate; and a plurality of serrations formed at least on an inner face of the bottom plate to bite the at least one bare conductor crimped by the crimp claws, wherein at least one of the serrations has a depth different from a depth of each another serration, wherein a depth of a center portion of the at least one serration in an extending direction thereof is shallower than depths of both end portions thereof.

2. A crimp terminal for crimping at least one bare conductor of at least one sheathed electric wire, comprising:

a bottom plate, on which the at least one bare conductor is placed;

a pair of crimp claws, extending from the bottom plate to crimp the at least one bare conductor placed on the bottom plate; and a plurality of serrations formed at least on an inner face of the bottom plate to bite the at least one bare conductor crimped by the crimp claws, wherein at least one of the serrations has a depth different from a depth of each another serration, wherein:

depths of serration closer to the both ends of the bottom plate are shallower than a depth of another serration, and portions of the bottom plate between each of the serrations are substantially the same thickness.

3. The crimp terminal as set forth in claim 2, wherein plural sheathed electric wires are placed at both ends of the bottom plate.

* * * * *